US006474807B1

(12) United States Patent
Honda

(10) Patent No.: US 6,474,807 B1
(45) **Date of Patent: *Nov. 5, 2002**

(54) RECORDING MEDIUM FOR INK-JET PRINTER

(75) Inventor: Chika Honda, Hino (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/563,215

(22) Filed: May 2, 2000

(30) Foreign Application Priority Data

May 13, 1999 (JP) ..... 11-133206

(51) Int. Cl.[7] ..... B41J 3/407
(52) U.S. Cl. ..... 347/106
(58) Field of Search ..... 347/105, 106; 428/195; 503/200

(56) References Cited

U.S. PATENT DOCUMENTS 3,874,876 A * 4/1975 Hibino et al. ..... 430/521
5,196,868 A * 3/1993 No et al. ..... 346/134
5,725,961 A * 3/1998 Ozawa et al. ..... 428/500
5,966,150 A * 10/1999 Lester et al. ..... 347/43

FOREIGN PATENT DOCUMENTS

JP 7276789 10/1995

* cited by examiner

*Primary Examiner*—John Barlow
*Assistant Examiner*—Michael S Brooke
(74) *Attorney, Agent, or Firm*—Bierman, Muserlian and Lucas

(57) ABSTRACT

A recording medium for an ink-jet printer comprising an ink-absorbing layer is disclosed. The turbidity of the recording medium is not less than 10% and less than 90%, or transmittance of the recording medium is less than 70% and not less than 35%.

recording medium comprises an ink-absorbing layer An image forming method employing the recording medium is also disclosed.

3 Claims, 3 Drawing Sheets

RECORDING MEDIUM FOR INK-JET PRINTER

FIELD OF THE INVENTION

This invention relates to a recording medium for an ink-jet printer used in the medical field such as a diagnosis by X-ray image or in the industrial field such as non-destructive inspection of shipbuilding and piping.

For example, in the field of medicine, digital image data of a simple radiographic image obtained by computed radiography or flat panel X-ray detector is imaged on a CRT display or a film after processing to applied for a conference of diagnosis or planning of a surgical operation and a medical education. This invention relates to a recording medium for an ink-jet printer to be used for imaging the medical image.

BACKGROUND OF THE INVENTION

From 100 years ago, the discovery of X-ray, a screen-film system or SF system composed of a combination of an intensifying screen and a film has been used for forming a radiographic image. A high running cost of the SF system cannot be ignore in the light of recently medical cost increasing since an expensive silver halide light-sensitive film and a processing chemicals for processing the film are used in the system.

Recently, a system for outputting a radiographic image in a form of digital electric signals such as the signals of a computed radiography (CR) and that generated by a flat panel X-ray detector (FPD) are proposed in the field of radiography in place of the SF system. In such the systems, a radiographic image can be rapidly imaged on a CRT display since no radiographic film is used and any complex process such as developing treatment is not necessary. However, the CRT display has problems such as that the density range of image is limited and the light emission intensity is considerably lowered in an using period of less than one year. Accordingly, a hard copy of radiographic image is required when the image is inspected in detail or used for a conference.

SUMMARY OF THE INVENTION

A method is utilized for obtaining such the hard copy, by which the electric signals of a radiographic image generated by CR or FDP are converted to the intensity of laser light beam and the image is printed by the light beam on a silver halide photographic film, and the film is processed. This method, however, is complex and requires a expensive cost since the silver halide photographic film is used as the same as in the usual SF system. A thermal transfer system and a sublimation type printer are usable as the method without use of the silver halide photographic film. However, in the thermal transfer system has a problem such that the ink image tends to peeled off since the ink is adhered on the most upper surface of the film. In the case of sublimation printer, sufficient image density cannot be obtained and rubbish such as an used ink ribbon is made.

The object of the invention is to solve the foregoing problems caused by the use of an ink-jet printer for forming a medical image, and to provide a recording medium for an ink-jet printing capable of forming a medical image which is low in the cast and easy to observe.

The other object of the invention is to provide an ink jet recording medium which is preferably employed in forming a medical image, in particular, radiographic image.

The medical images include a radiographic image, a ultrasonic image, a retinal image, an endscopic image, an MRI image and so on in the present invention. The invention is preferably applied to a radiographic image.

The invention is described below.

1. A recording medium for an ink-jet printer comprising an ink-absorbing layer which has ability of absorbing ink, wherein turbidity of the recording medium is not less than 10% and less than 90%.
2. The recording medium for an ink-jet printer of claim 1 wherein the ink-absorbing layer is an ink-absorbing layer having void.
3. The recording medium for an ink-jet printer of claim 1 wherein the ink-absorbing layer is an ink-absorbing layer is a void type.
4. The recording medium for an ink-jet printer of claim 2 wherein the ink-absorbing layer has ability of absorbing ink for an ink jet printer.
5. The recording medium for an ink-jet printer of claim 2 wherein transmittance of the recording medium is less than 70% and not less than 35%.
6. The recording medium for an ink-jet printer of claim 4 wherein the ink-absorbing layer has ability of absorbing ink in a liquid state at ordinary temperature.
7. The recording medium for an ink-jet printer of claim 2 wherein the recording medium further comprises a support and the ink-absorbing layer is provided on the support.
8. The recording medium for an ink-jet printer of claim 7 wherein the support absorbs blue region wavelength light.
9. The recording medium for an ink-jet printer of claim 1 wherein the recording medium absorbs blue region wavelength light.
10. The recording medium for an ink-jet printer of claim 7 wherein the support contains blue tinted resin.
11. The recording medium for an ink-jet printer of claim 7 wherein thickness of the support is not less than 75 $\mu$m and not more than 250 $\mu$m.
12. The recording medium for an ink-jet printer of claim 1 wherein the recording medium comprises a support containing a blue tinted resin and having a thickness of from 75 $\mu$m to 250 $\mu$m, and at least one of the ink-absorbing layer provided on at least one side of the support, on which a substantially monochromatic image to be formed with inks in a liquid state at the ordinary temperature.
13. The recording medium for an ink-jet printer of claim 7 wherein the ink-absorbing layers are provided on both sides of the support.
14. The recording medium for an ink-jet printer of claim 12 wherein the recording medium is a sheet form and four corners of the sheet are rounded, and a mark for distinguish front and back of the sheet is formed on the sheet.
15. A recording medium for an ink-jet printer comprising an ink-absorbing layer which has ability of absorbing ink, wherein transmittance of the recording medium is less than 70% and not less than 35%.
16. An image forming method comprising a step of jetting ink in accordance with image data on a recording medium for an ink-jet printer, the recording medium comprising an ink-absorbing layer and having turbidity of not less than 10% and less than 90%, whereby an image is formed.
17. The image forming method of claim 16 wherein transmittance of the recording medium is less than 70% and not less than 35%.
18. The image forming method of claim 16 wherein the step of jetting ink is jetting ink in accordance with image data concerning with medical image.

19. The image forming method of claim 18 wherein transmittance of the recording medium is less than 70% and not less than 35%.
20. The image forming method of claim 17 wherein the step of jetting ink is conducted by jetting ink on a recording medium for an ink-jet printer comprising a support containing blue tinted resin.
21. The image forming method of claim 16 wherein the ink-absorbing layer is an ink-absorbing layer having void.
22. The image forming method of claim 16 wherein the ink-absorbing layer is an ink-absorbing layer is a void type.
23. An image forming method comprising a step of jetting ink in accordance with image data on a recording medium for an ink-jet printer which recording medium has transmittance of less than 70% and not less than 35%.
24. A recording medium for an ink-jet printer comprising an ink-absorbing layer having void which has a turbidity of from not less than 10% to less than 90%.

In the invention 24, the turbidity is a ratio of scattered light to straight permeated light. When the turbidity is exceeds a certain value, the dazzlement is relieved. Besides an excessively high turbidity causes difficulty of the observation since the straight permeated light is excessively attenuated. Accordingly, a easily observable image as bright as possible and without dazzlement can be obtained when the turbidity of the ink-absorbing layer having void is within the range of from not less than 10% to less than 90%.

25. A recording medium for ink-jet printer comprising an ink-absorbing layer having void having a transmittance of less than 70% and not less than 35%.

In the invention 25, the transmittance is a intensity of light straight permeated through the layer. The image is difficultly observable when the transmittance is lowered, and the image is difficultly observable by dazzlement when the light transmittance is too high. Accordingly, a easily observable image as bright as possible and without dazzlement can be obtained when the turbidity of the ink-absorbing layer having void is within the range of from less than 70% to not less than 35%.

26. A recording medium for ink-jet printer comprising an ink-absorbing layer having void having a turbidity of from not less than 10% to less than 90% and a transmittance of from less than 70% to not less than 35%.

According to the invention 26, a easily observable image as bright as possible and without dazzlement can be obtained when the ink-absorbing layer having void has a turbidity and transmittance each selected from the range of from not less than 10% to less than 90% and a transmittance of from less than 70% to not less than 35%.

27. A recording medium for an ink-jet printer of 24 to 26 comprising a support which comprises a blue tinted resin and has a thickness of from 75 $\mu$m to 250 $\mu$m, and an ink-absorbing layer provided on a side of the support, on which a substantially monochromatic image to be formed with inks in a liquid state at the ordinary temperature.

According to the invention, a monochromatic image can be obtained which can be easily observed when the image is inspeced on a viewer by permeated light.

28. The recording medium of 27 is a sheet form and the four corners of the sheet are rounded, and a mark for distinguish the front and back of the sheet is formed on the sheet.

According to the invention, the recording medium is easy handled since the rounded corner reduces the possibility of injuring a person handling the sheet and the front and back of the medium can be distinguished at the first sight by the mark image so as to be free from the complicated operation.

DETAILED DESCRIPTION OF THE INVENTION

An embodiment of the invention is described below according to the drawings.

Figure 1:
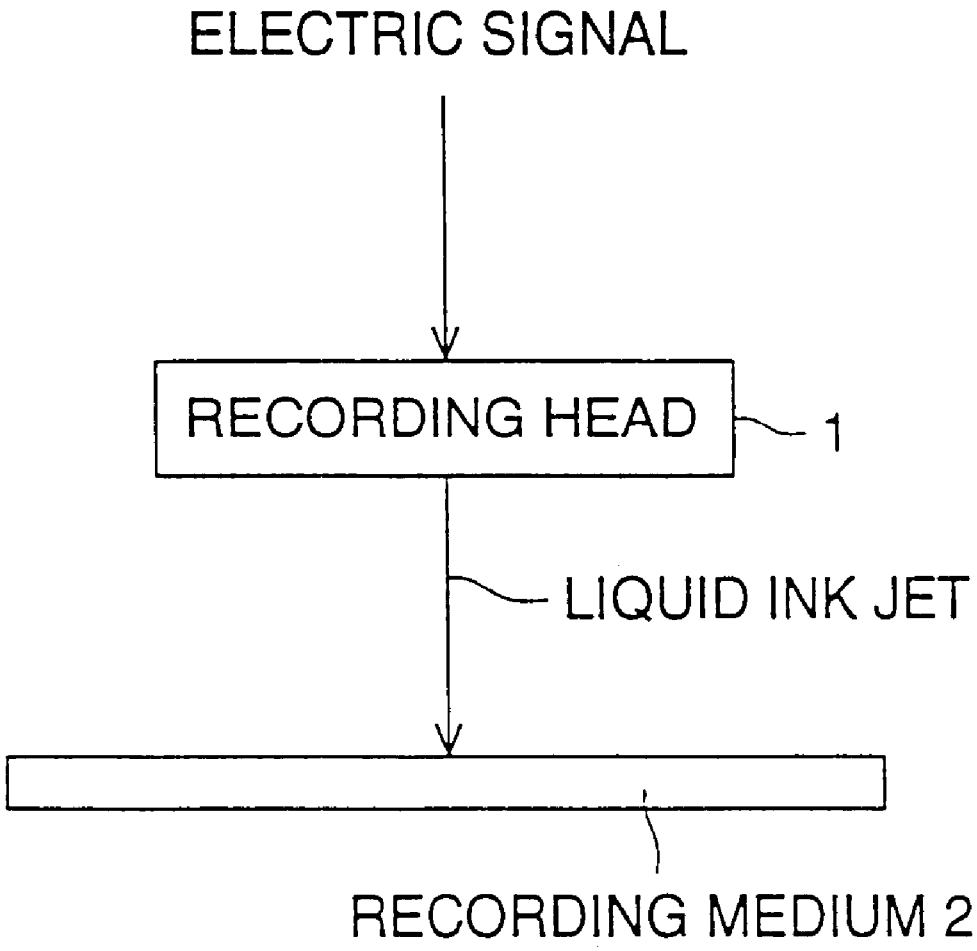
FIG. 1 shows a schematic drawing of an ink-jet printer.
Figure 2:
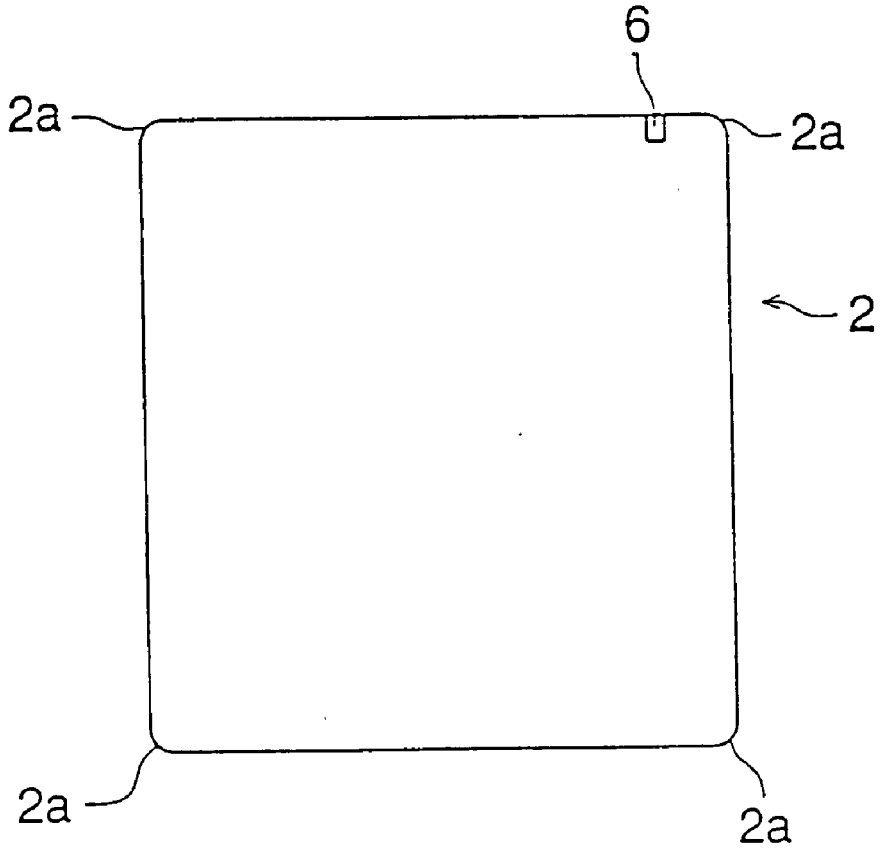
FIG. 2 shows plan view of a recording medium.
Figure 3:
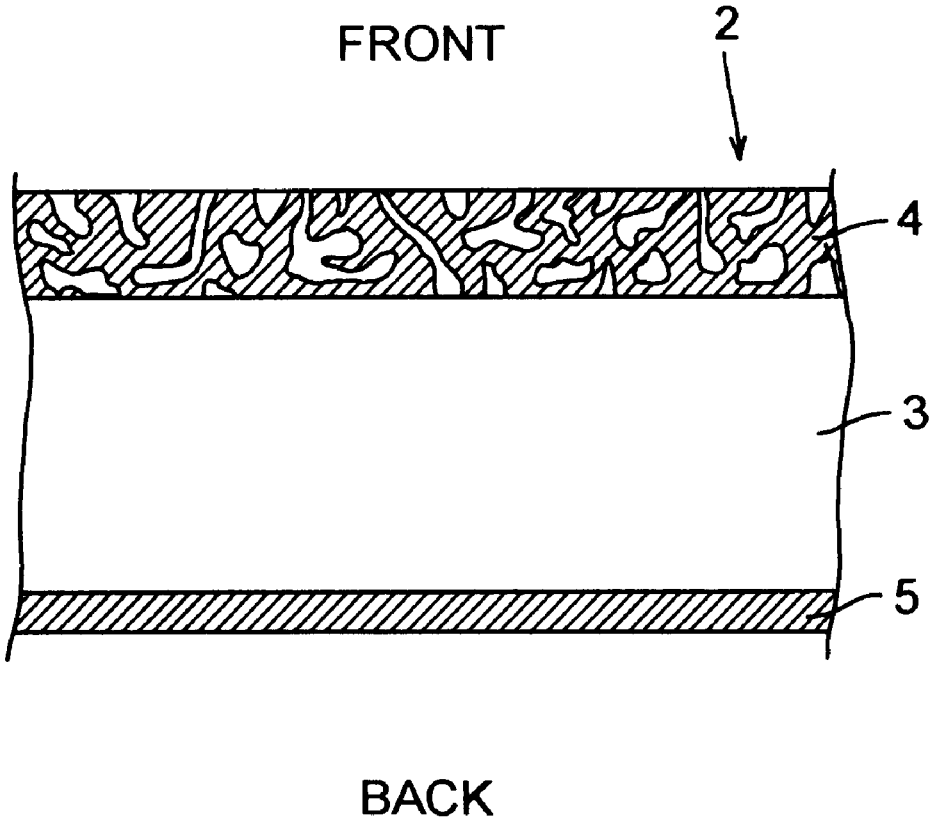
FIG. 3 shows a cross-section of a recording medium.

FIGS. 1, 2 and 3 each shows a schematic drawing of an ink-jet printer, plan view of a recording medium and a cross-section of a recording medium, respectively.

The ink-jet printer has a recording head 1. The recording head 1 continuously jets a small amount of liquid ink according to the input electric signals, for example, utilizing Piezo effect of a crystal, for adhering the ink on a recording medium 2 to form an image.

Accordingly, it is not necessary to discard any ink ribbon used, in contrast to printers by the thermal transfer method or the sublimation. Recently a recording medium having an ink-absorbing layer is used to obtain a high quality image such as that by silver salt photography. Particularly, a problem such as that the transfer of ink is not occurred when the medium having the ink-absorbing layer having void is used since the image is formed inside the ink-absorbing layer. In the ink-jet printer, expensive silver halide grains are not used and the running cost can be reduced since the processing chemicals are not required. A high quality radiographic image can be imaged according to the digital image signals obtained by CR or FPD by the use of inks and recording medium having ink receiving layer suitable for imaging an image suitable for the purpose of the use of the image.

Technology for imaging the radiographic image is not developed even though the ink-jet printer has such the advantage because an ink-jet technology satisfying the requirement of a high image quality in the field of medical technology is not established yet.

It is necessary to image radiographic image having a tone suitable for easy diagnosis for preparing a high quality radiographic image print by the ink-jet printer. A recording medium sheet comprising a transparent support on which an image is formed is mounted on a viewer to observe the transparent image at the time of the x-ray diagnosis. In such the case, the imaging medium itself considerably influences to the ease of viewing at the time observation of the image. This invention provides an ink-jet recording medium by which a printed of a radiographic image capable of giving ease diagnosis.

The radiographic image is observed as the transparent image by mounting the image on a viewer which is constituted by oriented fluorescent lamps and a translucent board covering the lamps for scattering light. A wider density range can be observed by the transparent image compared with a reflective image. In such the case, the image is a black monochromatic image, in contrast, a large amount of light permeated through the non-image area causes dazzling of eyes of the observer, and a high sensitivity area of the image is difficultly observed since the pupil of the eye of the observer is contracted. Accordingly it is preferable for inspecting the radiographic image as a transparent image to scatter a certain amount of light or reduce the permeated light by the recording medium. In another word, it is necessary that the recording medium is translucent. Of course, such the medium is different from an OHP sheet, the purpose of which is to permeate as large as possible amount of light through the sheet to project the image formed thereon. Regarding the OHP sheet, an effort is made so as to maintain the turbidity of the sheet within several percent. A recording medium to be used for an advertisement or room decoration image lighted by a back-light is also desired to permeate as large as possible amount of light since such the images are view at light out door or under a room light. For example, U.S. Pat. No. 4,592,951 discloses a substantially transparent ink-jet recording medium, and Japanese Patent Publication Open to Public inspection (JP O.P.I.) No. 7-276789 discloses that the ink receiving layer of a transparent ink-jet recording medium preferably has a light transmittance of not less than 70%. These disclosures are the embodiments of ink-jet recording medium for OHP sheet, of which purpose is to permeate a large amount of light for magnifying and projecting a transparent image on a screen, or for a back-lighted image to be viewed under a lighted condition. These sheets are unsuitable for observing the light transparent image on the viewer. Besides, when a turbidity and transparence suitable for viewing on the viewer are given to the OHP sheet, the image is unsuitably darkened.

The monochromatic image is substantially imaged by a mono-color and the image information is not expressed by variation of color. In the case of monochromatic image to be observed on the viewer by the permeated light, the dazzlement can be relieved when the turbidity of the recording medium exceeds a certain degree. Besides, an excessively high turbidity caused excessive reduction in the attenuation of permeated light and the image becomes difficultly observable. Accordingly, the turbidity of the recording medium for the monochromatic ink-jet printing is preferably less than 90% and not less than 10%, more preferably less than 80% and not less than 15%.

Such the turbidity can be obtained by making the void in the ink-absorbing layer to as large as possible and making rough the surface by matting treatment. Moreover, the turbidity can be controlled by adding a white metal oxide such as titanium oxide and lead oxide into the ink-absorbing layer or a layer arranged under the ink-absorbing layer. Moreover, a desired turbidity can be obtained by providing a layer on the back side of the support, on which the ink-absorbing layer is not provided, and in the layer a metal oxide such as titanium oxide and the lead oxide is dispersed, or by arranging the ink-absorbing layers on the both side of the support for controlling the turbidity.

The transmittance is preferably not less than 35% and less than 70%, more preferably not less than 40% and less than 60%. When the transmittance is lowered, the observation of the image becomes difficult, and when light is excessively permeated, the observation of the image becomes difficult by the dazzlement. It is preferable, for example, that the support is blue tinted for suitably reduce the transmittance. The transpareny also controlled by the foregoing method for raising the turbidity.

The turbidity and the transmittance are physical values different from each other. The turbidity is a ratio of the amount of light scattered by a sample to the amount of light permeated through the sample when the sample is irradiated by light. The transmittance is a ratio of the amount of light permeated through the sample to the amount of incident light. A larger turbidity corresponds to a larger amount of scattered light, and a larger transmittance corresponds to a larger amount of permeated light. Accordingly, it is preferable that the two parameters are selected from the foregoing ranges for obtaining a easily observable image having a high brightness without dazzlement. The recording medium for ink-jet printer according to the invention is that having an ink-absorbing layer having void and a turbidity selected from the range of from not less than 10% to less than 90% and a transparence selected from the range of from less than 70% to not less than 35%.

The turbidity and the transmittance can be easily measured by a turbidimeter (integral sphere photoelectric scattering photometer) Model T-2600A with a light source of a halogen lamp according to JIS K-0101, manufactured by Tokyo Densiki Gijutu Center Co., Ltd. The permeated light amount is reduced by the absorption and the scattering by the material in the sample to be measured. The scatter of light is also occurred by the roughness of the sample surface or the void in the sample.

The recording medium for ink-jet printer according to the invention is preferably has a shape of sheet as shown in FIG. 2 from the viewpoint of easy handling. The recording sheet according to the invention is preferably comprises a blue tinted resin sheet permeating a certain amount of light having a thickness of from 75 $\mu$m to 250 $\mu$m and rounded four corners 2*a*, and on at least one side thereof the ink-absorbing layer. In actual medical scene, a lot of pictures should be observed. At this time, it is anxiety that the person handling the sheet is injured if the four corners of the rectangular sheets of the recording medium 2 are not rounded. The "rounded" shape means the corner has a shape of smooth arc. The arc is preferably a part of circle having a diameter of not less than 1 mm. When a sheet having a size exceeding a certain size, a sufficient stiffness is required. Therefore, the thickness of the sheet is preferably approximately 175 $\mu$m.

For the material of the support 3 of the recording medium 2, a polyester such as poly(ethylene terephthalate), a cellulose derivative such as nitrocellulose and cellulose acetate, a polysulfon, a polyimide and a polycarbonate may be used. The sheet-shaped recording medium is preferably blue tinted. The spectrum of the blue tinted support has at least one absorption maximum in the region of 560 nm or more. The blue color of tinting gives effects of relieving the dazzlement of eye by excessive permeated light through the non-image area and improving the tone of the black image.

It is necessary to provide an ink-absorbing layer having void 4 on at least one of the surfaces of the sheet-shaped recording medium 2. Therefore, the adhesiveness of the support 3 of the recording medium 2 with the ink-absorbing layer having void 4 should be raised by a treatment by corona discharge, flame or UV irradiation. In the invention, the layer having void is a layer which absorbs a colorant such as the ink to form an image. The layer having void contains a resin and fine particles. The layer is constituted by the fine particles themselves (or primary particles) or secondary particles formed by the coagulation of the primary particles bonded with together by the resin. A void is formed in the layer by suitably control of the ratio of the particles to the resin, and the ink is accepted in the void. Such the layer comprised of the particles and the resin and having the void is referred to the layer having void. The ink-absorbing layer having void has a void ratio of from 40 to 90%. The void ratio is given by dividing the void volume by whole volume of coating calculated by thickness of the coating. The void volume is measured in accordance with the Paper and Pulp Testing Method No. 48–85 (J. TAPPI). Any particles may be used as the fine particles as long as the layer can be formed. Fine particles composed of an organic substance and inorganic particles are usable, and the inorganic particles are preferable for forming the layer. For example, various kinds of natural or synthesized inorganic fine particles such as that of silica, calcium carbonate, titanium oxide, zinc oxide, alumina, barium sulfate, magnesium carbonate and calcium silicate, are usable.

The fine particles may be one without any treatment or one covered on the surface thereof with an organic compound such as a cationic polymer. When the recording medium is a recording medium for ink-jet recording, silica or alumina is preferably used for forming the ink receiving layer of the ink-jet recording medium for the reason of a low refractive index thereof.

Colloidal silica, cation-modified silica and silica synthesized by a gas phase method are preferably used. Among them, and a cationic complex fine particles produced by covering the silica synthesized by a gas phase method with a cationic polymer are preferred since a high void ratio can easily be obtained by the use of such the fine particles.

Fine particles having various average diameters are usable as long as the layer having void can be formed by the particles. It is preferable to use fine particles having an average diameter of not more than 300 nm for obtaining the effect of the invention. Although there is no lower limit on the diameter of the particles, the diameter of the particles is preferably not less than 5 nm, and the average diameter of the particles is preferably from 5 to 80 nm.

The silica synthesized by gas phase method having an average primary particle diameter of not more than 100 nm, particularly not more than 30 nm, is preferable as the inorganic particles for forming the ink receiving layer of the ink-jet recording medium. The average diameter of the fine particles can be determined by simple average (number average) of diameters of optionally selected 100 particles which are measured by electron microscopic observation on the particles themselves or the cross-section of the layer having void. The diameter of the individual particle is defined by the diameter of a circle having the same area of the projection area of the particles.

A binder is preferably used in the layer having void. A hydrophilic binder is particularly preferred. Known various kinds of hydrophilic binder are usable, and the preferably used hydrophilic binder is different depending on the ionicity, anionic or cationic, of the inorganic particles.

A nonionic or an anionic binder is used when the surface of the inorganic particles is anionic, and a nonionic or a cationic binder is used when the surface of the inorganic particles is cationic. Two or more kinds of binder may be used in combination. Examples of the nonionic binder include gelatin, poly(vinyl alcohol), poly(ethylene oxide), polyacrylamide, polyvinylpyrrolidone, hydroxyethyl cellulose and dextran.

The anionic binder is a hydrophilic polymer having an anionic group such as a carboxyl group and a sulfo group, for example, poly(acrylic acid), carboxymethyl cellulose, agar, carrageenan and dextran sulfate.

Examples of the cationic hydrophilic binder include ones produced by cationically modifying a nonionic water-soluble polymer such as cationically modified poly(vinyl alcohol) and cationically modified polyvinylpyrrolidone, and a water-soluble polymer having a quaternary ammonium base. The ratio of the fine particles to the binder is approximately within the range of from 2 to 10 by weight.

In the recording medium, the hydrophilic binder is preferably hardened by a hardening agent to reduce cracking. The hardening agent-is usually a compound having a group capable of reacting with the hydrophilic binder or a compound capable of accelerating the reaction between the different groups each contained in the hydrophilic binder. The hardener is suitably selected according to the kind of the hydrophilic binder.

Concrete examples of the binder include an epoxy type hardener such as diglycidyl ethyl ether, ethylene glycol diglycidyl ether, 1,4-butanediol diglycidyl ether, 1,6-diglycidylcyclohexane, N,N-diglycidyl-4-glycidyloxyaniline, sorbitol polyglycidyl ether and glycerol polyglycidyl ether, an aldehyde type hardener such as formaldehyde and glyoxal, a reactive halogen type hardener such as 2,4-dichloro-4-hydroxy-1,3,5-s-triazine, a reactive vinyl compound such as 1,3,5-trisacroyl-hexahydro-s-triazine and bisvinylsullfonylethyl ether, boric acid and its salts, borax and aluminum alum.

A hardener selected from boric acid and its salts and epoxy type hardeners is preferably used when the poly(vinyl alcohol) or cationically modified poly(vinyl alcohol) is used as the particularly preferable hydrophilic binder.

A hardener selected from boric acid and its salts is most preferable.

In the invention, boric acid and its salts are an oxygenic acid and is salt in which the central atom is a boron atom. Concrete examples of boric acid and its salts include orthoboric acid, diboric acid, metaboric acid, tetraboric acid, pentaboric acid, octaboric acid and salts thereof.

The using amount of the foregoing hardener is usually from 5 to 500 mg, preferably from 10 to 300 mg, per gram of the hydrophilic binder even though the amount is varied depending on the kind of the hydrophilic binder, the kind of the hardener, the kind and the ratio of the fine particles to the hydrophilic binder.

The hardening agent may be added into a coating liquid for forming the layer having void or a coating liquid for forming another layer at the time of coating. The hardening agent may be supplied to the layer having void by the coating the coating liquid of the layer having void on a support on which a layer containing the hardening agent is previously coated, or by overcoating a solution of the hardening agent onto the previously coated and dried layer having void containing no hardening agent. It is preferred from the viewpoint of production efficiency that the hardening agent is simultaneously supplied at the same time of formation of the layer having void by adding the hardening agent into the coating liquid of the layer having void or the coating liquid of a layer adjacent to the layer having void.

It is preferable that the three dimensional network structure of the ink-absorbing layer having void is constituted by the inorganic or organic fine particles having an average diameter of not more than 20 nm and the water-soluble resin, and the weight ratio of the inorganic or organic fine particles to the water-soluble resin is within the range of from 1.2:1 to 12:1. The average diameter of the fine holes forming the void is within the range of from 5 to 40 nm, and the volume of the fine holes is within the range of from 0.3 to 1 ml/g. It is preferable that the inorganic particle is inorganic silicic acid having 2 to 3 silal groups per square nanometer and has a chain structure constituted by bonding the secondary particles having a diameter of from 10 to 300 nm which is formed by coagulation of the inorganic particles.

The ink-absorbing layer having void 4 preferably has a specific surface area of from 50 to 500 $m^2/g$. Furthermore, a matting particle having an average diameter of from 5 to 100 $\mu m$ may be dispersed on the surface of the recording medium to prevent adhesion of the recording media 2 caused by piling the recording media 2.

A surfactant may also be added for preventing static electricity. A backing layer 5 may be provided on the surface of the support 3 on which the ink-absorbing layer having void is not provided. The backing layer 5 is formed by coating gelatin or another water-soluble resin to prevent curling of the sheet. The backing layer 5 may be subjected to a anti-static treatment, a matting treatment for preventing adhesion, a blue tinting treatment and an addition of a metal oxide particle such as titanium oxide or zinc oxide.

When the transparent radiographic image is inspected, a lot of films are frequently handled within a shortened period. At this time, the handling can be released from complication if the front and the back of the image can be distinguished at first sight. For example, the front and the back side of the recording medium 2 can be easily distinguished by making a notch 6 as the distinguishing mark at the right-upper shoulder of the recording medium 2.

EXAMPLE

Example 1

As is shown in FIG. 3, the both sides of a polyester base support 3 blue-tinted in a visible density of 0.12 having a thickness of 175 mm were subjected to corona discharge treatment. A coating liquid was prepared by adding a surfactant and a titanium oxide dispersion to a gelatin solution, and the liquid was coated on a surface of the support so that the coated amount of gelatin and titanium oxide were 2 g/m$^2$ and 0.04 g/m$^2$, respectively, to form a backing layer 5 for preventing curling and static electricity. An ink-absorbing layer having void 4 is formed on the other side of the support by-coating the following liquid.

Composition of a coating liquid of the ink-absorbing layer having void is shown below.

Sample 1

Dry processed silica fin particle Aerogel A300 (average diameter: 7 nm, silalol group: 2–3/nm$^2$) 1 kg Polyvinyl alcohol PVA235 (manufactured by Kurare Co., Ltd., saponificated ratio: 88%, polymerization degree: 3500) 0.4 kg.

The above-mentioned composition was dispersed to 14 kg of water, and 50 g of boric acid and 50 g of borax were added to the dispersion. Then the dispersion was adjusted to a pH value of 4, thus a coating liquid was prepared. The liquid was coated on the foregoing film to prepare Sample 1. Comparative sample 1 was prepared in the same manner as in Sample 1 except that a polyester film without blue-tinting having a thickness of 175 $\mu$m was used.

Sample 2

Alumina fine particle Aluminum Oxide C (average diameter: 13 nm) 1 kg

Polyvinyl alcohol PVA235 (manufactured by Kurare Co., Ltd., saponificated ratio: 88%, polymerization degree: 3500) 0.4 kg.

The above-mentioned composition was dispersed to 14 kg of water, and 50 g of boric acid and 50 g of borax were added to the dispersion. Then the dispersion was adjusted to a pH value of 4, thus a coating liquid was prepared. The liquid was coated on the foregoing film to prepare Sample 2.

Sample 3

| | |
|---|---|
| Dry processed silica fin particle Aerosil A300 (average diameter: 7 nm, silalol group: 2–3/nm$^2$) | 1 kg |
| Polyvinyl alcohol PVA235 (manufactured by Kurare Co., | 0.4 kg |

-continued

| | |
|---|---|
| Ltd., saponificated ratio: 88%, polymerization degree: 3500) | |
| Titanium oxide | 0.5 g |

The above-mentioned composition was dispersed to 14 kg of water, and 50 g of boric acid and 50 g of borax were added to the dispersion. Then the dispersion was adjusted to a pH value of 4, thus a coating liquid was prepared. The liquid was coated on the foregoing film to prepare Sample 3.

Samples 4, 5, 6 and 7 were prepared in the same manner as in Sample 3 except that the amount of titanium oxide was each changed to 0.08 g/m$^2$, 0.16 g/m$^2$, 0.22 g/m$^2$ and 0.28 g/m$^2$, respectively. Moreover, Comparative samples 2, 3 and 4 were prepared in the same manner as in Sample 3 except that the amount of titanium oxide was each changed to 0.35 g/m$^2$, 0.41 g/m$^2$ and 0.56 g/m$^2$, respectively. Sample 8 was prepared in which a matting agent was dispersed in the ink-absorbing layer having void to raise the turbidity. Sample 9 was prepared in which a blue dye was added into the backing layer so as to reduce the transmittance.

The transmittance and the turbidity of thus obtained samples were measured by a turbidimeter Model T-2600DA (integral sphere photoelectric scattering photometer).

As for a CR image, image data of chest photographed by Regius 330, manufactured by Konica Corporation, were prepared. Besides, the samples of recording medium were each made a 14"×17" size sheet, the corners of which were rounded and a notch was made as shown in FIG. 2. The radiographic image of chest was imaged on the recording medium sheet according to the image data by a trial manufactured ink-jet printer using three kinds of black inks different in the density from each other. The maximum and the minimum density of thus obtained image was 2.4 and 0.5, respectively. The ease of observation of the image formed on each of the samples was visibly judged on a viewer lighted by 10,000 lux of light.

The judgment results were classified to 5 ranks.

A: Very easily observable

B: Easily observable

C: Observable difficultly a little, but acceptable for practical use

D: Difficultly observable

E: Very difficultly observable

Results of the judgment are shown in Table 1.

TABLE 1

| Sample No. | Transmittance | Turbidity | Judgment on image |
|---|---|---|---|
| Sample 1 | 67% | 18% | A |
| Sample 2 | 43% | 26% | B |
| Sample 3 | 67% | 18% | A |
| Sample 4 | 62% | 30% | A |
| Sample 5 | 53% | 52% | B |
| Sample 6 | 47% | 72% | B |
| Sample 7 | 42% | 86% | B |
| Sample 8 | 83% | 24% | C |
| Sample 9 | 62% | 8% | C |
| Comp. sample 1 | 81% | 7% | D |
| Comp. sample 2 | 32% | 93% | E |
| Comp. sample 3 | 25% | 95% | E |
| Comp. sample 4 | 8% | 97% | E |

As is shown in Table 1, Samples 1 through 7 each having a transmittance of from not less than 10% to less than 90% and a transparence of from less than 70% to not less than 30% give the excellent results. Sample 8 having a transmittance exceeding 70% was observed difficultly a little but acceptable for practical use. Sample 8 having a turbidity less than 10% was observed more difficulty, but acceptable for practical use.

Example 2

Samples 10 to 16 were prepared in the similar way to Sample 1 except that the adding amount of silica and titanium oxide were modified so as to have turbidity of 5, 12, 18, 30, 62, 78 and 83% respectively and transparency of 50±2%. The samples of recording medium were each made a sheet, the corners of which were rounded and a notch was made as shown in FIG. 2. The radiographic image data of metacarparal bone photographed by Regius 150, manufactured by Konica Corporation, was imaged on the recording medium sheet according to the image data by a trial manufactured ink-jet printer using three kinds of black inks different in the density from each other. The maximum and the minimum density of thus obtained image was 2.8 and 0.7, respectively. The ease of observation of the image formed on each of the samples was visibly judged on a viewer lighted by 10,000 lux of light in the same way as Example 1.

| Sample No. | Turbidity | Judgment on image |
|---|---|---|
| Sample 10 | 5% | C |
| Sample 11 | 12% | B |
| Sample 12 | 18% | A |
| Sample 13 | 30% | A |
| Sample 14 | 60% | A |
| Sample 15 | 78% | A |
| Sample 16 | 83% | B |

Example 3

Samples 17 to 23 were prepared in the similar way to Sample 1 except that the adding amount of silica and titanium oxide were modified so as to have turbidity of 33, 38, 46, 52, 58, 65 and 68% respectively and transparency of 30±2%. The samples of recording medium were each made a sheet, the corners of which were rounded and a notch was made as shown in FIG. 2. The radiographic image data of metacarparal bone photographed by Regius 150, manufactured by Konica Corporation, was imaged on the recording medium sheet according to the image data by a trial manufactured ink-jet printer using three kinds of black inks different in the density from each other. The maximum and the minimum density of thus obtained image was 2.8 and 0.7, respectively. The ease of observation of the image formed on each of the samples was visibly judged on a viewer lighted by 10,000 lux of light in the same way as Example 1.

| Sample No. | Turbidity | Judgment on image |
|---|---|---|
| Sample 17 | 33% | C |
| Sample 18 | 38% | B |
| Sample 19 | 46% | A |
| Sample 20 | 52% | A |
| Sample 21 | 58% | A |
| Sample 22 | 65% | B |
| Sample 23 | 68% | B |

As above-mentioned, according to the invention described in claim 1, an image capable of being easily observed with a brightness as large as possible and without dazzlement can be obtained by the turbidity of the recording medium having the void having ink-absorbing layer is from not less than 10% to less than 90%.

According to the invention described in claim 2, an image capable of being easily observed with a brightness as large as possible and without dazzlement can be obtained by the transmittance of the recording medium having the ink-absorbing layer having void is from less than 70% to not less than 35%.

According to the invention described in claim 3, an image capable of being easily observed with a brightness as large as possible and without dazzlement can be obtained by the turbidity of the recording medium having the ink-absorbing layer having void is from not less than 10% to less than 90% and the transmittance of that is from less than 70% to not less than 35%.

According to the invention described in claim 4, a monochromatic transparent image easily observable on a viewer can be obtained.

According to the invention described in claim 5, the possibility of injuring the person handling the recording medium is inhibited since the corner of the recording medium is rounded, and the front and back side of the medium can be distinguished at first sight by the distinguishing mark so as to be released from the complication of handling.

What is claimed is:

1. An image forming method comprising a step of jetting ink in accordance with image data on a recording medium for an ink-jet printer, the recording medium comprising an ink-absorbing layer and having turbidity of not less than 10% and less than 90%, and transmittance of the recording medium is not less than 35% and less than 70%, and the ink-absorbing layer comprises a plurality of voids formed therein, whereby an image is formed with inks in a liquid state.

2. The image forming method of claim 1 wherein the step of jetting ink is jetting ink in accordance with image data concerning with medical image.

3. The image forming method of claim 1 wherein the step of jetting ink is conducted by jetting ink on a recording medium for an ink-jet printer comprising a support containing blue tinted resin.

* * * * *